US005658368A

United States Patent [19]

Diaz et al.

[11] Patent Number: 5,658,368

[45] Date of Patent: Aug. 19, 1997

[54] REDUCED DUSTING BATH METHOD FOR METALLURGICAL TREATMENT OF SULFIDE MATERIALS

[75] Inventors: Carlos Manuel Diaz, Mississauga; Samuel Walton Marcuson, Sudbury; Anthony Edward Warner, Burlington; Geoffrey Edwin Osborne, Welland, all of Canada

[73] Assignee: INCO Limited, Toronto, Canada

[21] Appl. No.: 401,081

[22] Filed: Mar. 8, 1995

[51] Int. Cl.[6] ..... C22B 15/06; C22B 23/02

[52] U.S. Cl. ..... 75/585; 75/629; 75/639

[58] Field of Search ..... 75/585, 629, 639–643, 75/645, 650, 651, 652, 648, 649, 646, 640, 638

[56] References Cited

U.S. PATENT DOCUMENTS

| | | | |
|---|---|---|---|
| 4,127,408 | 11/1978 | Weigel et al. | 75/650 |
| 4,469,513 | 9/1984 | Staib | 75/76 |
| 4,493,732 | 1/1985 | Melcher et al. | 75/639 |
| 5,180,423 | 1/1993 | Marcuson et al. | 75/643 |
| 5,215,571 | 6/1993 | Marcuson et al. | 75/649 |
| 5,281,252 | 1/1994 | Landolt et al. | 75/585 |
| 5,449,395 | 9/1995 | George | 75/645 |
| 5,458,672 | 10/1995 | Ding | 75/643 |

FOREIGN PATENT DOCUMENTS

| | | | |
|---|---|---|---|
| 954700 | 8/1974 | Canada | 53/281 |
| 952319 | 8/1974 | Canada | 53/351 |

OTHER PUBLICATIONS

"Bath Smelting Processes in Non–Ferrous Pyrometallurgy" by H.H. Kellogg and C. Diaz, pp. 39–65, Proceedings of the Savard/Lee International Symposium on Bath Smelting, ed. by J.K. Brimacombe et al., The Minerals, Metals & Materials Society, 1992.

*Primary Examiner*—Melvyn Andrews
*Attorney, Agent, or Firm*—Edward A. Steen

[57] ABSTRACT

A pyrometallurgical vessel suitable for continuous or semi-continuous smelting and/or conversion of molten base metal sulfide feed materials. The top blown, bottom stirred vessel includes oxidizing gas lances and feed pipes directing their respective contents directly or indirectly into bath eyes opened up in the molten bath by gas injected through porous plugs disposed at the base of the vessel. Low space velocities in the vessel result in reduced dusting.

13 Claims, 1 Drawing Sheet

REDUCED DUSTING BATH METHOD FOR METALLURGICAL TREATMENT OF SULFIDE MATERIALS

TECHNICAL FIELD

The instant invention relates to the pyrometallurgical treatment of nonferrous sulfide materials in general and, more particularly, to a low dusting bath system and associated method for the continuous or semicontinuous conversion and/or smelting of base metal sulfide materials to crude metal or high grade matte.

BACKGROUND ART

A number of continuous or semi-continuous conversion processes for base metal sulfide materials have been proposed. They can be broadly grouped into bath and flash conversion processes.

The former group includes continuous (or semi continuous) conversion of copper sulfide to semiblister copper and iron-containing base metal matter to crude metal or higher grade matter as discussed in U.S. Pat. Nos. 5,281,252; 5,215,571; and 5,180,423 (the Inco process); continuous copper conversion as discussed in Canadian patents 552,319 and 954,700 (the Mitsubishi process).

In the Inco process solid base metal sulfide materials are fed to the converter, while in the Mitsubishi process, the feed to the converter consists of molten matte. In both the Inco and Mitsubishi converters, the oxidizing gas is blown onto the molten bath by means of lances.

To the latter group belong the Into and Kennecott-Outokumpu flash conversion processes. In both these cases, finely comminuted high grade copper matte reacts with the oxidizing gas in suspension over the molten bath.

While all of the above processes represent major advances over traditional Peirce-Smith batch conversion, they have drawbacks. The operation of the Mitsubishi continuous converter depends on the supply of molten matte; thus, interruptions in primary smelting result in a net loss of production. Converter refractory erosion and corrosion by the very aggressive lime ferrite slag used in the process are also a problem, although this has been somewhat alleviated by intensive use of water-cooled copper blocks in the converter wall. Injection tuyere wear limits converter productivity in the Inco copper sulfide bath conversion process. In addition, the particular geometry of the system disclosed in U.S. Pat. No. 5,180,423 results in the generation of relatively high space velocities between the vessel end walls and the off-gas exit and, consequently, in high dusting when feeding finely comminuted materials by simple dropping onto the surface of the bath. Furthermore, this geometry limits the number of blowing lances to two and, in the conversion of iron-containing mattes, is not conductive to optimal delivery of the oxidizing gas to appropriate regions of the surface of the bath, thus resulting in occasional overoxidation of the slag (U.S. Pat. No. 5,215,571). Substantial dusting, in particular when processing high grade copper matte (white metal) is a problem inherent in flash conversion.

There are other bath continuous or semicontinuous smelting and converting processes such as the Noranda, El Teniente and Vanyukov processes, which use tuyeres to supply the oxidizing gas and even the solid feed to the smelting or converting vessel. Foaming of the slag may occur in these systems when the desired product, e.g. blister copper, results in the simultaneous production of highly oxidized slags. Also relevant are the Mitsubishi smelting furnace and the recently developed Isasmelt (also known as Ausmelt or Sirosmelt) processes which use lances to blow the oxidizing gas at high velocities to cause vigorous agitation of the bath. Refractory wear and rapid lance consumption are difficulties associated with these processes.

Assignee has pioneered the use of porous plugs in the converter to bottom sparge the bath from below the surface. Top blowing techniques have been developed to direct oxygen containing gases into the area directly above the porous plugs (U.S. Pat. Nos. 5,180,423 and 5,215,571). However, dusting is still a problem as noted in U.S. Pat. No. 5,281,252.

SUMMARY OF THE INVENTION

Accordingly, there is provided a treatment system that substantially reduces dusting associated with current processing apparatus.

The top blown, bottom stirred converting vessel includes porous plugs disposed at the base of the vessel. Oxidizing gases are blown onto the surface of the bath toward or into the center of at least one of the circles of influence of the porous plugs. The rising stream of gas from the porous plugs opens up circles of influence or "bath eyes" through the slag layer exposing fresh matte therebelow. Feed is dropped into the circles of influence of other porous plugs with reduced dusting.

BRIEF DESCRIPTION OF THE DRAWING

The FIGURE is a simplified partial cross-sectional elevation of an embodiment of the invention.

PREFERRED MODE FOR CARRYING OUT THE INVENTION

Figure 1:
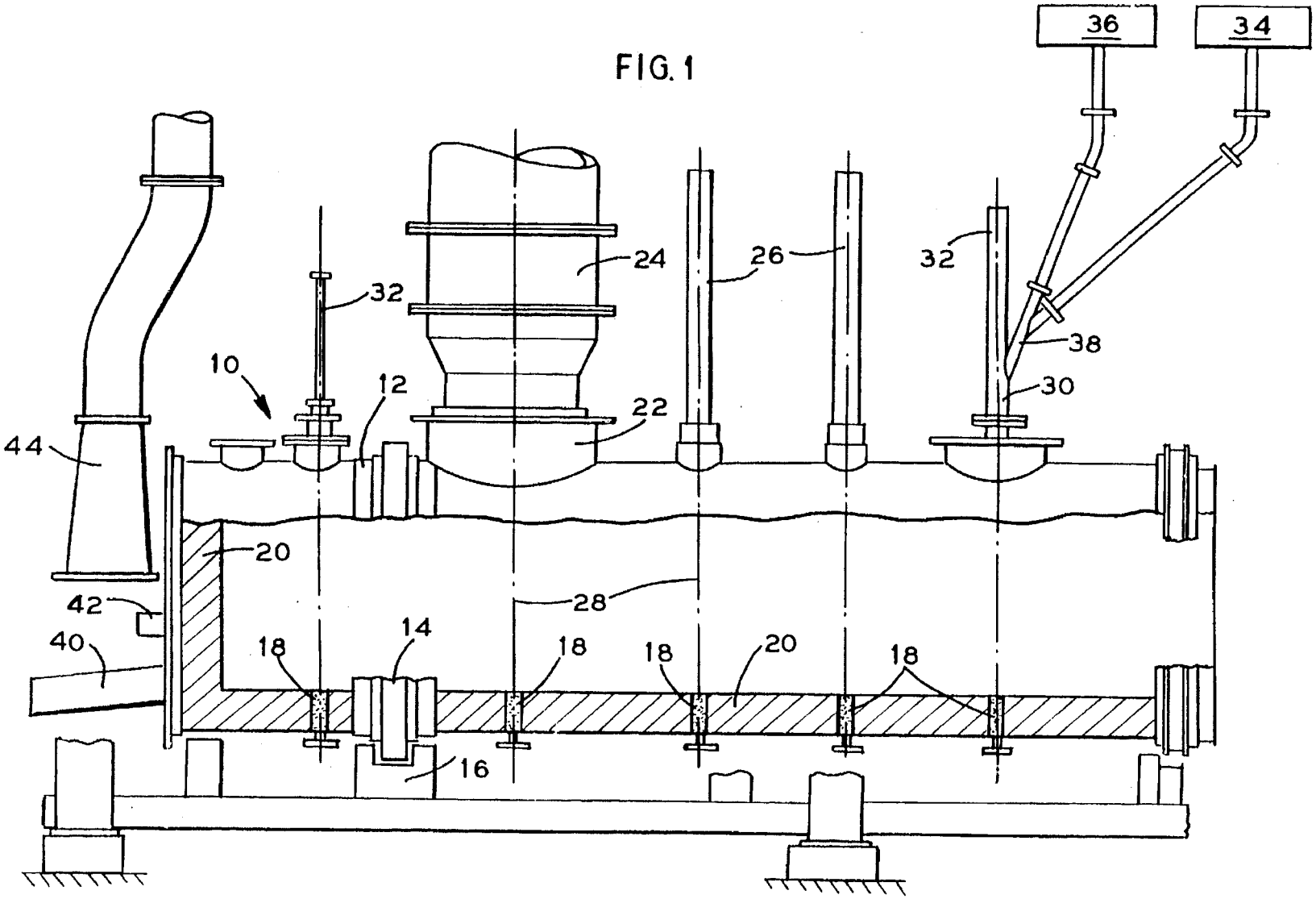

The FIGURE depicts a non-limiting example of a pyrometallurgical vessel 10 useful for continuous conversion of non-ferrous matte although it is not limited thereto. The vessel 10, shown empty, is preferably of rectangular horizontal cross section having an elongated cylindrical body 12.

The vessel 10, if desired, may be rotated in a conventional manner by the use of at least one matched set of meshed rollers 14 and 16. The roller 14 circumscribes the body 12 whereas the roller 16 further acts as a support. Rotation is imparted to the rollers 14 and 16 by standard mechanical means.

The vessel 10 is lined with refractory material, usually tightly ensconced brick, forming a substantially continuous lining 20.

A plurality of refractory porous plugs 18 disposed at the base of the vessel 10 and within the lining 20 permit the injection of inert sparging gases into the molten bath that may consist of the finished product. The rising gas emanating from the plugs 18 results in an effective and uniform agitation of the bath, thus enhancing heat and mass transfer throughout the vessel 10.

For the purposes of this invention, the expressions "areas or spheres of influence of a bath eye" are used. These connote the generally circular bath eye and its immediate surrounding vicinity formed by the inert gases rising up through the bath and exposing the matte. The size and depth of the bath eye and its accompanying sphere of influence is a function of the viscosity of the bath and the pressure, speed and volume of the gas flowing through the bath. The ultimate aim of the invention is to direct the feed, oxidizing gas and/or burner output broadly toward an area of influence or, more particularly, directly into the bath eye itself.

Process off-gases, containing sulfur dioxide, are vented through a mid-vessel opening 22 in the roof into exhaust duct 24 for additional treatment.

The oxidizing gas, generally pure oxygen or oxygen enriched air, is blown onto the surface of the bath by means of retractable lances 26. The lances 26 are positioned in the roof to blow directly into the center of the porous plugs 18. Alternatively, they may adjacently blow onto the areas or spheres of influence of the porous plugs 18. During operation, the sparging gases, as they rise up through the bath, open up a bath eye through the relatively thick slag layer, thus exposing fresh matte or sulfur containing metal to the action of the oxidizing gas. Accordingly, it is preferred to position the lances 26 so that they play directly or indirectly into the circle of influence of the porous plugs 18. This may be done by sighting the lances 26 directly over the plugs 18 wherein their respective center lines 28 are directly superimposed. Alternatively, the lances 26 may be oriented off center so that they direct at least a substantial portion of the oxidizing gas into the vicinity of the eye. This may be accomplished by canting the lances 26 at the appropriate angles in the roof of the vessel 10 to approximately target the gas flows emerging from the plugs 18.

Gas volumes and pressures are a function of the vessel geometry, bath depth, materials being treated, etc. The kinetics must be such that the bath is sufficiently agitated but not violently disturbed. By judiciously selecting the gas flow parameters, the bath eye will be opened, the bath agitated and the freeboard space velocity minimized.

Feed such as solid base metal sulfide, which may consist of one or a blend of the following materials: high grade ore, concentrate, granulated or comminuted matte, plus flux as required, is dropped either directly into or adjacent to the center of circles of influence of other porous plugs 18 by means of retractable pipe 30 inserted through the roof of the vessel and positioned between a blowing lance 26 and the respective end wall. Although in a preferred embodiment of the present invention dry sulfide material is fed to the vessel, the system accepts wet feed. Burners 32, preferentially of the oxy-fuel type, are provided in the roof at each end of the vessel 10 to compensate for heat deficiencies as required. The burners 32 are conveniently located to enhance rapid melting of the solid feed.

In the embodiment shown, a source of sand/flux 34 and a source of crushed matte 36 share a common feed line 38. The feed line 38 may be directly associated with the burner 32 or it may be oriented in the vicinity of the burner 32.

As with the lances 26, the feed pipe 30, which may or may not be aligned with a burner 32, drops its feed directly into or adjacent to the center of a bath eye. It is preferred to align the feed pipe 30 and the burners 32 directly with the center line (axis of symmetry) 28 of the plugs 18.

The particular geometry of the continuous conversion system of the present invention results in very low gas space velocities at the points of feeding of the solid sulfide material, thus minimizing dusting. It has been discovered that even when feeding dry finely comminuted materials the rate of dusting is as low as 1% by weight of feed.

Space velocity (also known as empty tube space velocity) is defined as the volumetric flow of gas in a particular defined area of the vessel divided by that cross sectional area. In conventional converters, the space velocity is high causing tremendous dusting problems when fine particles are introduced into the vessel. The total kinetic energy of the gases in the freeboard is such that any fine particle is quickly blown about the vessel.

In contrast, the instant system generates extraordinarily low space velocities thereby imparting correspondingly low kinetic energy to the feed particles. The bath is still being bottom stirred but the kinetics of the gases within the freeboard are sufficiently quiescent to allow for smooth uninterrupted dropping of the feed into the bath eyes without debilitating dusting.

In another embodiment of the present invention, the sulfide feed may consist solely or partly of molten primary smelting matte. Launders may be used to continuously transfer and deliver this material above the surface of the bath of the proposed system.

In the event the vessel is not to be rotated, a tap 42 is provided to drain the matte and/or slag into a trough 40. A hood 44 routes the resulting emissions away for additional treatment.

Tapping metal product and skimming of slag can be practiced continuously or intermittently. In conversion of iron-free copper sulfide to blister copper, no slag is produced. Blister can be continuously overflowed, tapped in batches or even poured through the off-gas opening (mouth) 22 if the converter is of the cylindrical tilting type. In the latter case, the converter mouth has to be positioned to avoid molten bath invasion of the blowing lances, feed pipes and burner openings. In conversion of iron containing nonferrous mattes there are also various tapping and skimming options. The slag and metal product can be simultaneously and continuously overflowed to a holding vessel, in which case a very thin layer of slag exists on the surface of the molten bath. Alternatively, the slag layer may be allowed to reach a depth compatible with continuous or intermittent overflowing of the slag while still permitting the development of matte eyes under the lances delivering the oxidizing gas. In this latter case, the metal product can be continuously or intermittently tapped.

Applicants have piloted the system of the present invention using crushed iron containing copper-nickel matte and also finely comminuted nickel containing copper sulfide material, which is produced by separation of a low iron (1%) nickel-copper matte. The following two examples, taken from this experimental testwork, better illustrate the nature and advantages Of the present invention.

EXAMPLE A

Continuous Converting of Bulk Furnace Matte By Top Blowing/Bottom Stirring 269 tonnes of bulk copper-nickel primary smelting matte were continuously converted in Inco's pilot plant flash smelting reactor (FSR) 10. The internal dimensions of the vessel 10 are approximately 25 feet (7.62 m) long and approximately 5 feet (1.52 m) in diameter.

Preferred space velocities for the introduction of feed may range from about 0.05 to about 0.5 actual (at 1250° C.) meters per second. For comparison purposes in the existing low dusting Inco flash furnace, space velocities in the horizontal freeboard are about 1 meter/second. The space velocity employed in the instant invention is about an order of magnitude less than the low dusting flash furnace.

For this test work, the FSR 10 was quipped with five porous plugs 18 for bottom nitrogen injection and two vertical, water-cooled oxygen lances 26, 0.5" (1.27 cm) internal diameter, as shown in the FIGURE. Also as shown in the FIGURE are the solids feeding pipe 30 and two oxygen-natural gas burners 32. The feeding pipe 30 was mounted flush with the reactor's 10 roof. One of the burners 32 was conveniently located beside the feed pipe 30 to contribute to melting in the solids. The porous plugs 18 for nitrogen injection were positioned as follows: one under the feeding pipe 30, one under each of the oxygen lances 26, one under the uptake 22, and one under the north (left) side burner 32.

The campaign consisted of 14 continuous conversion heats, each lasting approximately 10 hours. Mean test conditions and assays of feed and products are given in Table 1. The primary matte was crushed to 100% - ½" (1.27 cm).

Under steady state conditions, the distance from the tip of the feed pipe 30 to the bath was 95 cm. The feed, primary matte plus the necessary siliceous sand flux, fell onto a bath eye created in the slag layer by the nitrogen injected through the porous plug 18 located underneath the feed pipe 30. Continuous converting was accomplished by the oxygen blown through the two vertical lances 26. Each of the oxygen jets impinged on a respective bath eye. The distance from the tip of the oxygen lances to the bath surface was either 25 or 50 cm. The temperature of the molten bath, i.e. about 1250° C. for the matte and 1280°–1300° C. for the slag, was maintained by a combination of the heat generated by the convening reactions and the heat supplied by the natural gas burners 32.

The tap 42, located in the FSR 10 north (left) end wall, was used to continuously overflow product matte and slag in most of the heats. This mode of operation minimized the depth of the slag layer, thus facilitating the formation of bath eyes under the feed pipe 30 and the oxygen lances 26. However, in a few heats, the matte was tapped separately through passages (not shown) located in the reactor's 20 north end wall while still allowing the slag to overflow. This procedure permitted the depth of the slag layer to be increased to about 11 cm. The rising plumes of nitrogen from the plugs 18 still created bath eyes in the thicker slag layer, and the oxygen efficiency was similar to that observed in the heats with combined overflow of matte and slag.

The mean oxygen efficiency demonstrated during this campaign exceeded 90%. Matte with as little as 4.2% Fe was produced while maintaining good slag fluidity. The mean dusting rate was very low, i.e. 0.33 wt % of the feed matte. No accumulation of unmelted solids under the feed pipe 30 occurred. The vessel 10 tapped out cleanly at the end of the campaign, except for buildup on the walls, above the bath level, resulting from splashing near the oxygen lances 26.

TABLE 1

| Mean Test Conditions | |
|---|---|
| Matte feed rate, kg/h | 1990 |
| Sand flux rate, kg/h | 160 |
| Distance of oxygen lances from bath, cm | 25–50 |
| Converting $O_2$/Matte wt ratio | 0.184 |
| Porous plugs $N_2$, L/min/plug | 20–30 |

| Assays of Feed and Products (%) | Cu | Ni | Co | Fe | S | $SiO_2$ |
|---|---|---|---|---|---|---|
| Primary matte | 25.3 | 22.1 | 0.62 | 22.7 | 26.2 | 0.7 |
| Product matte | 37.1 | 33.3 | 0.55 | 6.3 | 21.7 | — |
| Slag | 1.6 | 2.1 | 0.60 | 49.9 | 0.9 | 23.0 |

EXAMPLE B

Continuous Converting Of Copper Sulfide ($Cu_2S$) By Top Blowing/Bottom Stirring 263 tonnes of bone-dry, nickel-containing $Cu_2S$ concentrate obtained from Cu/Ni Bessemer matte and known as MK were continuously converted to semiblister, i.e, sulfur-saturated copper, in Inco's pilot plant FSR 10. Besides composition, particle size is the main difference between this material and the bulk copper-nickel concentrate of Example A. MK is extremely fine with an average particle equivalent diameter of only 11 μm. Accordingly, one of the main objectives of the test work was to measure the MK dusting rate.

The vessel configuration, i.e. location of porous plugs, oxygen lances, feeding pipe and burners, was essentially the same as described in Example A. However, this time, the feed pipe 30 terminated in a water-cooled section to allow insertion into the FSR 10 and, in turn, study of the possible effect on dusting of feed pipe tip height above the bath, i.e. solids dropping distance.

Twelve continuous converting heats were conducted, each lasting 10–12 hours. The principal test conditions for each week of this campaign are summarized in Table 2 which also gives the compositions of the MK feed and the product semiblister. No slag is produced in conversion of MK to semiblister.

During feeding, a small mount of nitrogen, sufficient to establish a tip space velocity of 2.8 m/sec, was put through the pipe 30. The nitrogen flow provided a seal from the FSR freeboard and may have helped to smooth the feeding. As shown in Table 2, the distance from the tip of the feed pipe to the bath was varied from 25 cm to 95 cm. At the longer distance, the tip of the pipe was flush with the roof of the FSR 10. The dusting rate was very low in all cases, i.e., 0.9 to 1.8 wt %, and showed no dependence on feed dropping height.

Bath temperature was maintained at about 1300° C. by the heat generated by conversion, supplemented by the natural gas burners. Oxygen efficiency during conversion was approximately 80%. No problems were experienced with melting and digestion of the MK feed.

TABLE 2

CONVERSION OF COPPER SULFIDE

| Test Conditions | Week 1 | Week 2 | Week 3 |
|---|---|---|---|
| Concentrate feed rate, kg/h | 1700 | 1700 | 1700 |
| Distance of oxygen lances from bath, cm | 50 | 50 | 50 |
| Converting $O_2$/feed wt ratio | 0.19 | 0.22 | 0.22 |
| Distance of feed pipe from bath, cm | 25 | 50 | 95 |
| Porous plugs $N_2$ rate, L/min/plug | | 20–30 | |

| Assays of Feed and Products (%) | Cu | Ni | S |
|---|---|---|---|
| Concentrate | 71–76 | 2.4–3.5 | 20–23 |
| Semiblister | 91–94 | 3.3–4.0 | 1.2–1.6 |

In summary, the system of the present invention teaches a top blown, bottom stirred arrangement of porous plug bubblers, blowing lances, feeding pipes and burners within a vessel to provide: effective and uniform agitation of the molten bath, thus enhancing heat and mass transfer; fresh metallic phase bath eyes through a relatively thick slag layer, when present, under the lances blowing the oxidizing gas and under the pipes dropping the solid feed; low gas space velocities in the regions of feeding, thus permitting dropping dry finely comminuted materials with minimal dusting. In addition, the stirring, blowing and feeding devices are independent from each other and can be conveniently operated or shutdown separately, with the sole exception of the porous plug bubblers which have to pass inert gas while submerged in the molten bath.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the inventions in which an exclusive property or privilege is claimed are defined as follows:

1. A low dusting method for smelting and/or converting a bath of molten non-ferrous materials, the process comprising:

a. providing a reactor vessel having a bottom portion, a roof, opposed end walls, and a chamber therebetween;

b. creating a molten bath of non-ferrous materials in the vessel;

c. forming at least one bath eye having a sphere of influence thereabout in the molten bath by the injection of gas through the bottom portion of the chamber and below the surface of the molten bath to agitate and bottom stir the molten bath with a rising plume of gas therein;

d. introducing oxidizing gas directly toward the sphere of influence of a bath eye from above the molten bath for top blowing the molten bath;

e. drop feeding solid feed directly toward the sphere of influence of a bath eye from above the bath at a minimal gas space velocity of about 0.05 to about 0.5 meters per second to reduce dusting within the reactor;

f. playing a burner directly toward a sphere of influence into a bath eye; and g. removing the molten material from the vessel.

2. The method according to claim 1 including continuously converting copper sulfide to semiblister copper.

3. The method according to claim 1 including tapping at least a portion of the molten material.

4. The method according to claim 1 including continuously converting copper-nickel matte.

5. The method according to claim 1 wherein an oxidizing gas lance is movable through a distance from being flush with the roof to a predetermined distance above the molten bath.

6. The method according to claim 1 wherein an inert gas envelopes the feed.

7. The method according to claim 1 wherein an inert gas is injected into the molten bath through porous plugs disposed within the bottom of the vessel.

8. The method according to claim 1 wherein process gases are exhausted through a vessel egress mounted in the roof and directly above a bath eye.

9. The method according to claim 1, wherein the feed is simultaneously and colinearly introduced into the vessel in conjunction with a gas burner.

10. The method according to claim 1 wherein the feed is selected from the group consisting of sulfide ore, concentrate, matte and mixtures thereof.

11. The method according to claim 1 including introducing the oxidizing gas directly into a bath eye.

12. The method according to claim 1 including introducing the feed directly into a bath eye.

13. The method according to claim 1 including playing the burner directly into a bath eye.

* * * * *